US005669034A

United States Patent [19]

Yamada

[11] Patent Number: 5,669,034

[45] Date of Patent: Sep. 16, 1997

[54] PHOTOGRAPHIC MATERIAL DEVELOPING APPARATUS

[75] Inventor: Junji Yamada, Wakayama, Japan

[73] Assignee: Noritsu Koki Co., Ltd., Wakayama-ken, Japan

[21] Appl. No.: 600,405

[22] Filed: Feb. 12, 1996

[30] Foreign Application Priority Data

Feb. 16, 1995 [JP] Japan ..... 7-027970

[51] Int. Cl.[6] ..... G03D 3/08

[52] U.S. Cl. ..... 396/615

[58] Field of Search ..... 354/298, 319–322, 354/338, 339; 226/196, 198, 199; 396/569, 570, 612, 615, 617

[56] References Cited

U.S. PATENT DOCUMENTS 4,903,064 2/1990 Kogane et al. ..... 354/321

FOREIGN PATENT DOCUMENTS 6-64326 11/1994 Japan .

*Primary Examiner*—D. Rutledge
*Attorney, Agent, or Firm*—Felfe & Lynch

[57] ABSTRACT

A photographic material developing apparatus having processing tanks (8), and rack units (10) removably mounted in the processing tanks, respectively. Each of the rack units supports a pair of guide members (11) for guiding a photographic material (1) passing through the processing tanks. The guide members are movable relative to each other to vary a distance therebetween defining a passage width of the photographic material. The relative position between the guide members is variable to adjust the passage width of the photographic material. This relative position is variable by a first drive line disposed outside each rack unit, and a second drive line provided for each rack unit. The first drive line and the second drive line are selectively connected and disconnected, which is carried out through a connected member (85) disposed on the first drive line, and a connecting member (81) disposed on the second drive line. A guide mechanism (60; 160) is provided for determining a relative position between the connecting member (81; 181) and connected member (85; 185) to allow the connecting member and connected member to be connected to each other in a predetermined relative position.

9 Claims, 10 Drawing Sheets

PHOTOGRAPHIC MATERIAL DEVELOPING APPARATUS

BACKGROUND OF THE INVENTION

1. Field of the Invention

The present invention relates to a photographic material developing apparatus including processing tanks, and rack units removably mounted in the processing tanks, respectively, each rack unit having a pair of guide members with a variable distance therebetween for guiding a photographic material passing through the processing tanks. More particularly, the invention relates to these rack units.

2. Description of the Related Art

In a photographic material developing apparatus as noted above, the rack units transport a photographic material such as exposed film or exposed printing paper successively through a plurality of processing ranks storing different processing liquids to develop the photographic material.

U.S. Pat. No. 4,903,064, for example, discloses such rack units each including a guide width varying mechanism for adjusting a distance between a pair of guide members, a first drive line for transmitting power from an external drive source, a second drive line connected to the guide width varying mechanism for driving the latter with the power received from the first drive line, and a coupling for enabling and disabling power transmission from the first drive line to the second drive line. The coupling has a connecting member connectable to a connected member included in the first drive line. The connecting member is connected to the second drive line.

Different types of photographic materials have different widths. It is therefore necessary to adjust a photographic material passage width, i.e. the distance (guide width) between the pair of guide members, to suit a photographic material to be transported. Thus, each rack unit includes the guide width varying mechanism for varying a relative position between the pair of guide members. i.e. a guide width. The relative positions between the pairs of guide members in all of the rack units mounted in the processing tanks are adjusted to a passage width of the photographic material to be transported.

For inspection, adjustment or the like, it is necessary to withdraw the rack units from the processing tanks. Therefore, the rack units are removably mounted in the processing tanks. The processing tanks have a drive line for simultaneously driving the guide width varying mechanisms of the rack units. When the rack units are placed in the processing tanks, this drive line is drivingly connected through the coupling to a drive line of each rack unit for driving the guide width varying mechanism.

However, when one of the rack units is withdrawn from the processing tank and the guide width varying mechanism is inspected or adjusted, the relative position between the pair of guide members may be varied. It is therefore necessary, when placing this rack unit back in the processing tank, to connect the drive lines while adjusting the relative position between the pair of guide members to agree with the relative positions between the pairs of guide members in the other rack units remaining in the processing tanks. This adjusting and connecting operation is quite troublesome.

SUMMARY OF THE INVENTION

The object of the present invention is to realize a proper adjustment of the relative position between a pair of guide members, and a simple connection between the drive lines, when installing each rack unit in a processing tank.

The above object is fulfilled, according to the present invention, by rack units wherein a coupling for enabling and disabling power transmission from a first drive line disposed outside each rack unit to a second drive line provided for each rack unit includes a connected member disposed on the first drive line, a connecting member disposed on the second drive line, and an automatic adjusting device.

With the above construction, when each rack unit is mounted in one of the processing tanks, the relative position between the connecting member and connected member is automatically adjusted to allow the two members to be connected to each other in a predetermined relative position. As a result, a desired interlocking is established between the first drive line and second drive line. That is, a passage width (guide width) formed between a pair of guide members of the rack unit mounted may be made equal to a passage width (guide width) formed between pairs of guide members of the other rack units remaining in the respective tanks. Thus, each rack unit may be mounted in place while adjusting the pair of guide members and connecting the first and second drive lines with ease.

In a preferred embodiment of the present invention, the automatic adjusting device includes a guide mechanism for assisting the connecting member in displacement relative to the connected member, whereby the connecting member and connected member are connected to each other in the predetermined relative position. This construction requires no special drive mechanism for guiding the connecting member. Where the guide mechanism includes ramps formed on the connected member, a positional adjustment is completed in the course of mounting the rack unit in the processing tank, to enhance smoothness in connecting the connecting member and connected member. A force of gravity may be utilized in the connecting operation by shaping the ramps to open upward.

In another embodiment of the invention, the connecting member is displaceable relative to the connected member, prior to connection therebetween, to cause the guide width varying device to vary the distance between the guide members, whereby the guide members define a passage width as a predetermined reference width. With this construction, the passage width defined between the guide members is made equal to the reference width simply by placing the rack unit in the processing tank. Based on this reference width, power is supplied through the drive lines to the guide width varying device to effect adjustment to a varied width. This feature contributes toward simplification of adjustment controls.

In a preferred embodiment of the invention, the connecting member includes a rack gear, and the second drive line includes a pinion gear meshing with the rack gear, a linear displacement of the connecting member relative to the connected member in time of connection therebetween is transmitted to the second drive line as a rotational displacement through the rack gear and the pinion gear. This rack and pinion mechanism realizes a simple construction for converting a linear displacement of the connecting member in time of connection into a rotational displacement for use by the guide width varying device in moving the guide members.

In a further embodiment of the invention, the automatic adjusting device includes sensors for detecting a displacement of the connecting member from the predetermined relative position, and a motor operable in response to signals from the sensors to correct a position of the connected member through the first drive line. This construction provides a possibility of automating the operations to connect the first and second drive lines and to place the rack units in the processing tanks with the aid of electronic control.

A structure for connecting the connecting member and connected member may adopt one of various known, i.e. commercially available, interlocking shapes. That is, the connecting member and connected member may have mutually fitting geometric configurations, respectively. This feature contributes toward a cost reduction.

Other features and advantages of the invention will be apparent from the following description of the preferred embodiments taken with reference to the accompanying drawings.

DETAILED DESCRIPTION OF THE PREFERRED EMBODIMENTS

An embodiment of the present invention, as used in developing film which is one example of photographic materials, will be described with reference to the drawings.

Figure 1:
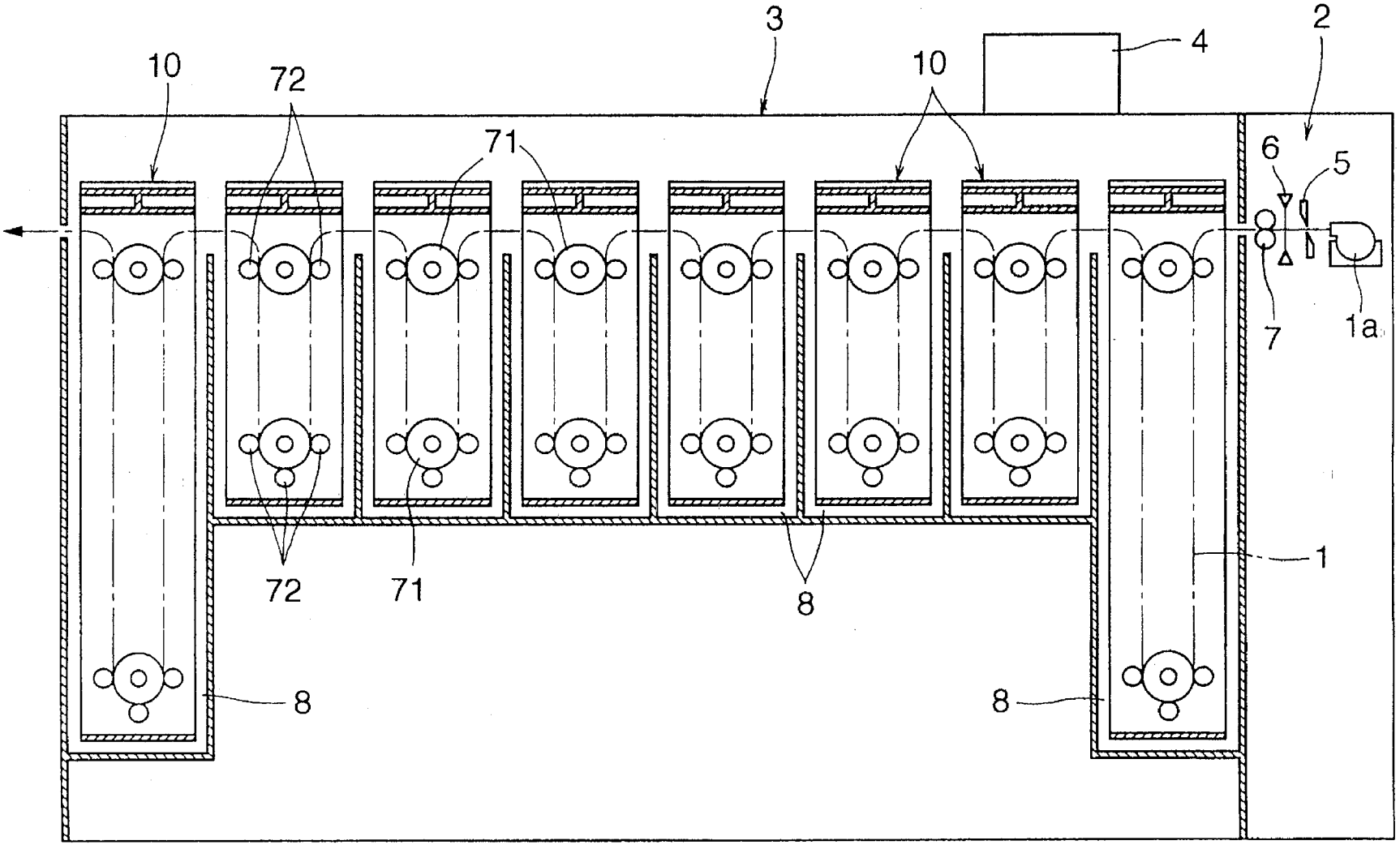
FIG. 1 is a schematic front view, in vertical section, of a photographic material developing apparatus according to the present invention.

As shown in FIG. 1, a photographic material developing apparatus includes, as principal components thereof, a film storage 2 for receiving a film holder 1*a*, a developing station 3 for developing film 1 drawn from the film holder 1*a*, and a control unit 4 for performing various controls of the developing apparatus.

The film 1 drawn from the film holder 1*a* is discharged from the apparatus after being developed and dried in the developing station 3.

As shown in FIG. 1, the film storage 1*a* includes a cutter 5 for cutting a rear end of film 1 drawn from the film holder 1*a*, a film width sensor 6 for detecting a width of film 1 drawn from the film holder 1*a*, and feed rollers 7 for drawing film 1 from the film holder 1*a* and feeding the film 1 to the developing station 3.

An outline of the developing station 3 will be described next.

Figure 2:
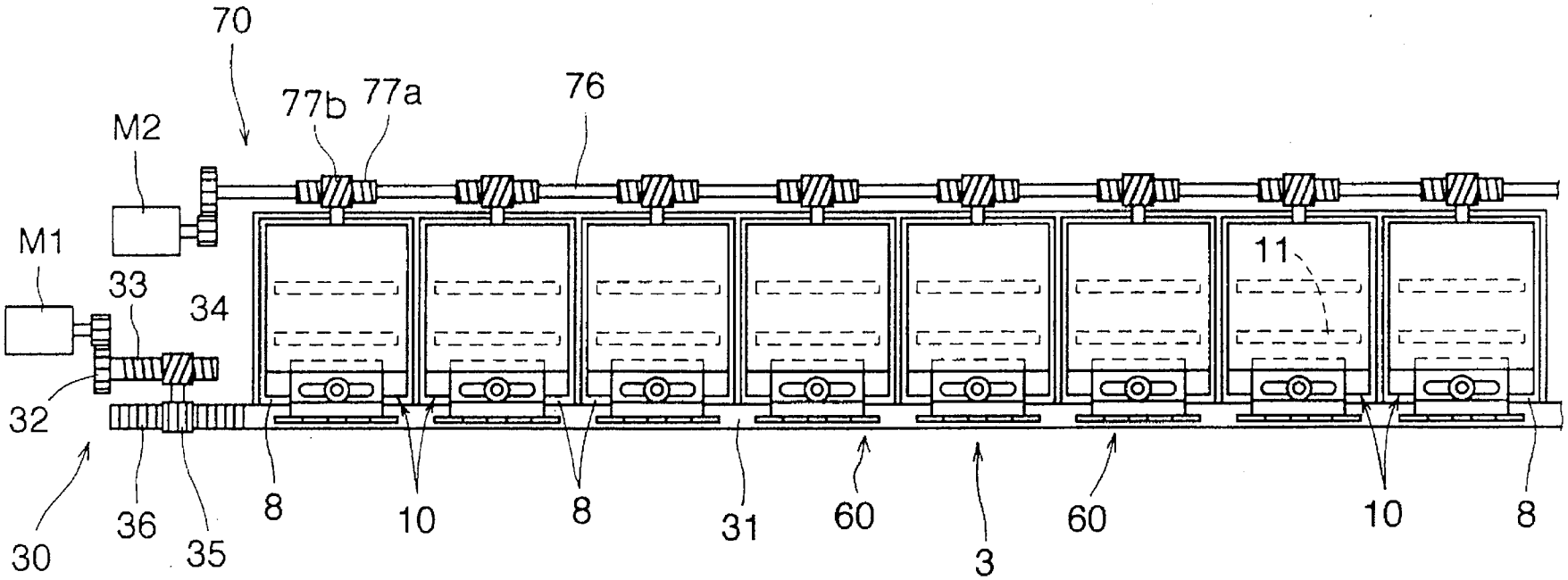
FIG. 2 is a schematic plan view of a developing station of the photographic material developing apparatus shown in FIG. 1.

As shown in FIGS. 1 and 2, the developing station 3 has a total of eight processing tanks 8 arranged in series. These tanks include seven processing tanks 8 filled with various processing liquids for effecting a series of developing processes from development to fixation, and one processing tank 8 disposed at a terminal end in a film transport direction for drying developed film 1.

The developing station 3 also has eight rack units 10 removably mounted in the processing tanks 8, respectively, and a transport mechanism 70 for transporting the film 1 successively through the eight processing tanks 8. The rack units 10 are inserted into the respective processing tanks 8 through upper openings of the tanks 8, and rest in the tanks 8 by gravity.

Figure 3:
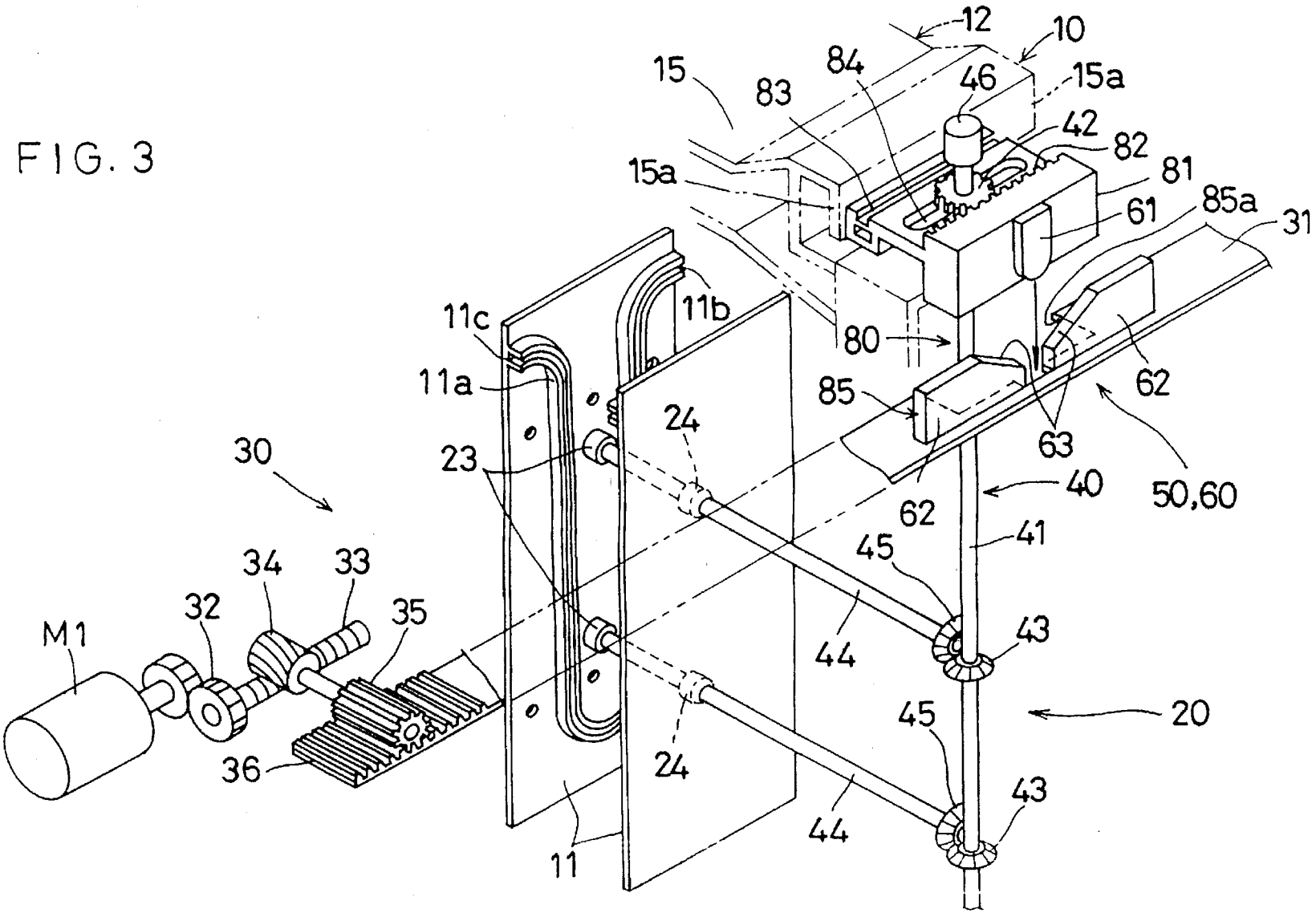
FIG. 3 is an exploded perspective view of a guide width varying device of the photographic material developing apparatus shown in FIG. 1.
Figure 4:
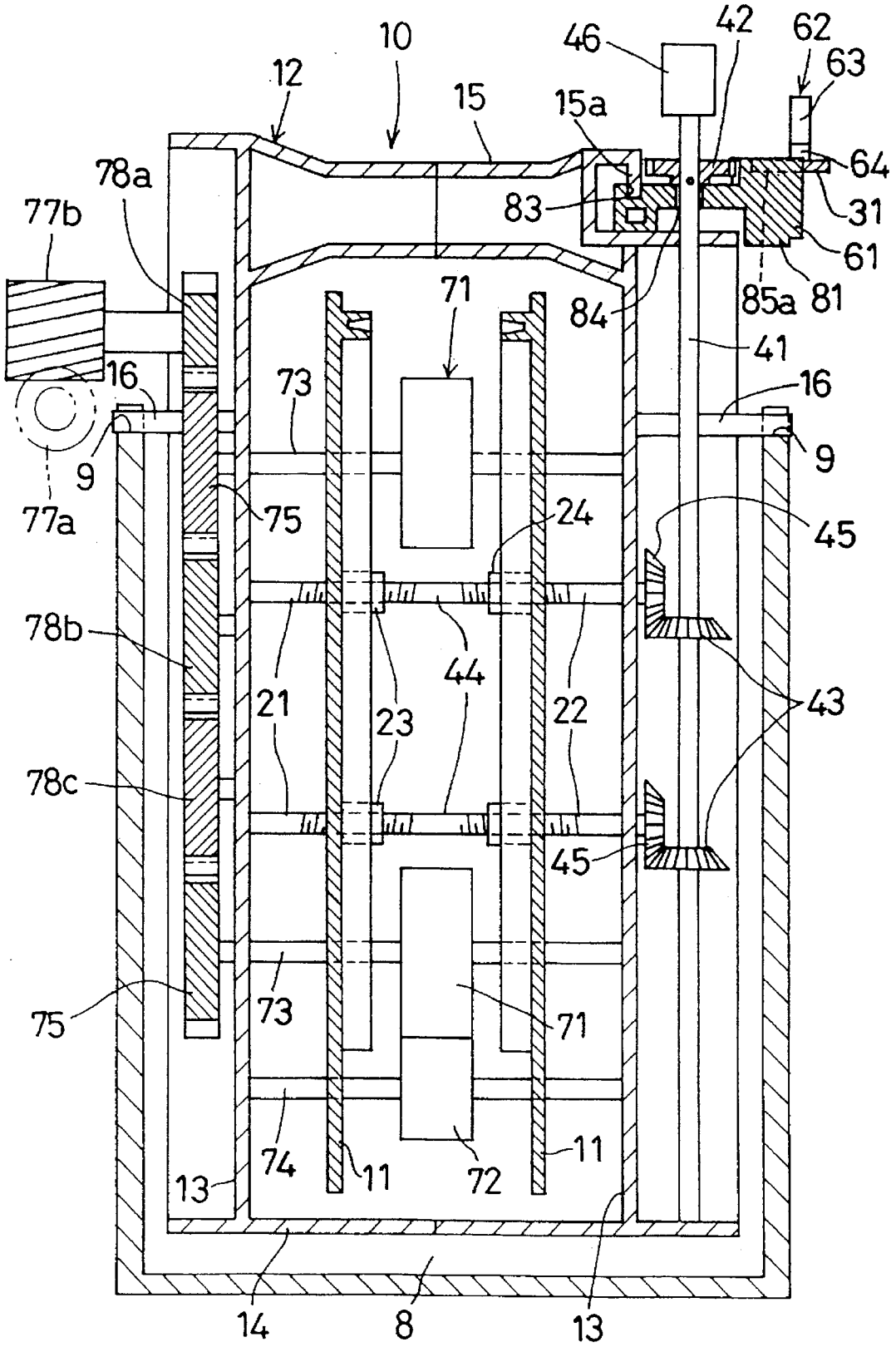
FIG. 4 is a side view, in vertical section, of the developing station.
Figure 5:
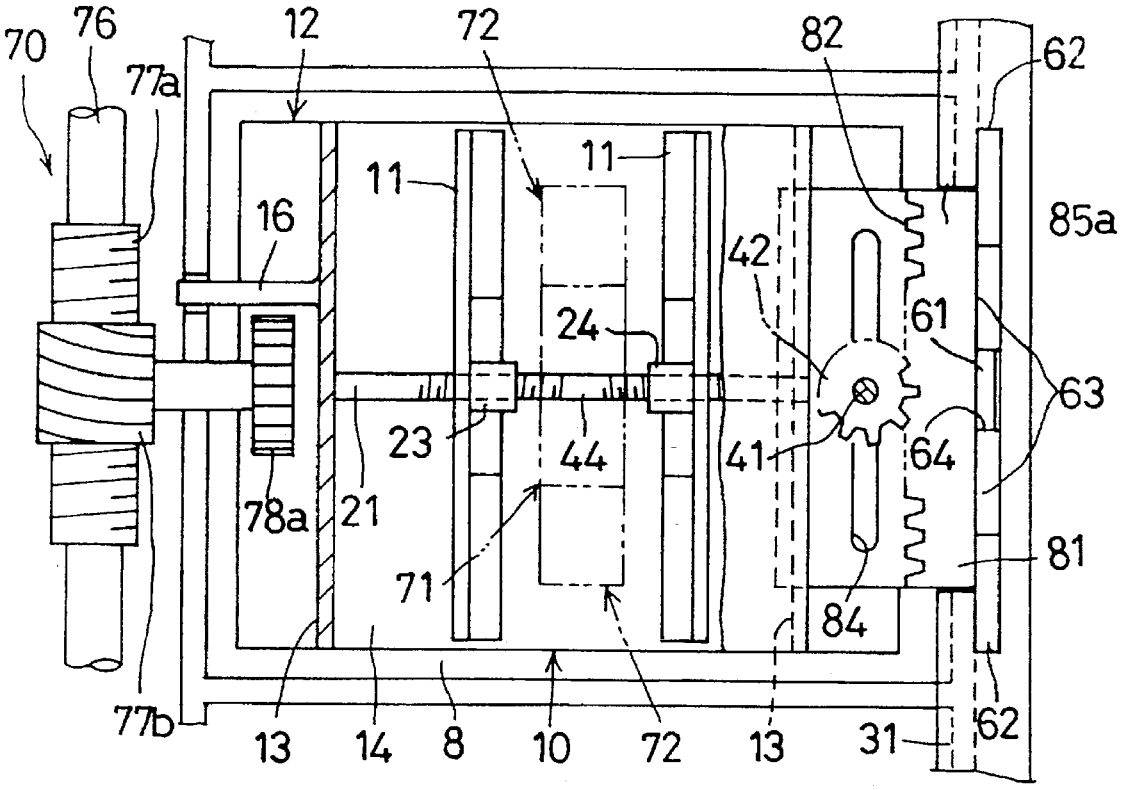
FIG. 5 is a plan view, in cross section, of the developing station.

As also shown in FIGS. 3 through 5, each rack unit 10 includes a pair of guide members 11 for supporting and guiding opposite side edges of the film 1, and a guide width varying device 20 for varying a relative position between the pair of guide members 11, i.e. a distance between the two guide members 11. The distance between the two guide members 11 defines a passage width of the film 1. A first drive line 30 extends along the processing tanks 8 for supplying power to the guide width varying devices 20 from outside the rack units 10 to drive the varying devices 20 synchronously. The first drive line 30 has a drive plate 31 acting as a central component thereof, which is a linear displacement transmitting plate extending and reciprocable along outer walls of the processing tanks 8. Each rack unit 10 includes a second drive line 40, which will be described in detail later, for transmitting power from the first drive line 30 to the guide width varying device 20. The first drive line 30 and second drive line 40 are switchable by a coupling device 80 between a connected state for enabling power transmission and a disconnected state for disabling power transmission. The coupling device 80 includes a connecting member 81 acting as an input of the second drive line 40, and a connected member 85 acting as an output of the first drive line 30. In this embodiment, the connected member 85 comprises plates formed integral with the drive plate 31 and defines a connecting cutout 85*a* for receiving the connecting member 81 when the rack unit 10 is mounted in the processing tank 8.

As also shown in FIGS. 3 through 5, an automatic adjusting device 50 is provided for automatically adjusting a relative position between the connecting member 81 and connected member 85, so that the connecting member 81 is placed in a predetermined proper connecting position relative to the connecting cutout 85*a* in the connected member 85 when the rack unit 10 is mounted in the processing tank 8. The proper connecting position is selected to establish an equal distance between the pair of guide members 11 for all the rack units 10 when the connecting members 81 of the respective rack units 10 engage the connecting cutouts 85*a*.

The automatic adjusting device 50 includes a guide mechanism 60 for guiding the connecting member 81 into the connecting cutout 85*a* when the rack unit 10 is mounted in the processing tank 8. As described in detail later, the guide mechanism 60 is formed on the drive plate 31.

Each component of the developing station 3 will be described with reference to FIGS. 3 through 6.

The rack unit 10 will be described first.

The rack unit 10 has a basic structure formed by a frame 12. The frame 12 has a substantially rectangular shape when seen in the film transport direction, including a pair of opposed parallel side walls 13, a bottom wall 14 and an upper wall 15. Each side wall 13 has a positioning pin 16 fixed thereto and extending outward in a horizontal direction. This positioning pin 16 engages a cutout 9 formed in an upper edge of a side wall of the processing tank 8 when the rack unit 10 is mounted in the tank 8. In this way, the rack unit 10 is set to a proper position relative to the processing tank 8. As will be described later, the upper wall 15 is bent downward to define a skirt 15*a* for supporting the connecting member 81 in reciprocating motion in the direction of arrangement of the processing tanks 8 (i.e. in the film transport direction).

The processing tanks 8 may have varied depths and varied lengths in the film transport direction, but have the same length transversely of the film 1. The rack units 10 have the same basic construction though different sizes depending on the sizes of the processing tanks 8.

The guide width varying device 20 of each rack unit 10 will be described next.

The guide width varying device 20 receives power through the second drive line 40. The second drive line 40 includes a pinion gear 42 meshing with a horizontal rack gear 82 formed on the connecting member 81, a rotary shaft 41 attached to the pinion gear 42 and rotatably supported by the bottom wall 14 and upper wall 15 of the frame 12, a pair of bevel gears 43 fixed to the rotary shaft 41, a pair of feed screw shafts 44 supported by the side walls 13, and a pair of bevel gears 45 fixed to ends of the feed screw shafts 44 and meshing with the bevel gears 43, respectively. A knob 46 is fixed to an upper end of the rotary shaft 41 for manually rotating this shaft 41. The guide width varying device 20 includes male screws 21 and 22 formed on each of the feed screw shafts 44 and having opposite threading directions, nuts 23 meshing with the male screws 21, and nuts 24 meshing with the male screws 22. One of the guide members 11 is fixed to the pair of nuts 23, while the other is fixed to the pair of nuts 24.

The connecting member 81 defines an elongate guide groove 83, a slot 84 extending parallel to the guide groove 83, and a positioning projection 61 formed on an outer wall of the connecting member 81. The connecting member 81 is assembled with the rotary shaft 41 extending through the slot 84, and the skirt 15*a* engaging the guide groove 83. Thus, under guiding action of the skirt 15*a*, the connecting member 81 is reciprocable on the frame 12 in the direction of arrangement of the processing tanks 8.

When the connecting member 81 is reciprocated linearly, the movement is transmitted through the rack gear 82 and pinion gear 42 to rotate the rotary shaft 41. The rotation of the rotary shaft 41 is transmitted through the bevel gears 43 and 45 to rotate the pair of feed screw shafts 44. The rotation of feed screw shafts 44 is transmitted through the male screws 21 and nuts 23 and through the male screws 22 and nuts 24 to move the pair of guide members 11 toward or away from each other to vary a relative position therebetween, i.e. a guide width which determines a passage width of film 1.

Further, the transport mechanism 70 is provided for the rack units 10 for transporting the film 1 through the processing tanks 8. The transport mechanism 70 includes transport rollers 71 and a roller drive line for driving the transport rollers 71, which will be described in detail later.

The drive plate 31 will particularly be described hereinafter with reference to FIGS. 3, 6A and 6B.

The elongate drive plate 31 extending over an entire length in the direction of arrangement of the processing tanks 8 is supported by the processing tanks 8 to be reciprocable linearly in the direction of arrangement.

Each connected member 85, i.e. the drive plate 31, defines the connecting cutout 85*a* for connection to the connecting member 81 supported by each rack unit 10. A positioning recess 64 is formed adjacent the connecting cutout 85*a* to be engageable by the positioning projection 61 of the connecting member 81. In this embodiment, the positioning recess 64 is defined by sides of two guide plates 62. The two guide plates 62 include upper surfaces defining ramps 63 which converge toward the positioning recess 64, i.e. open upward to perform a hopper-like function.

Figure 6A:
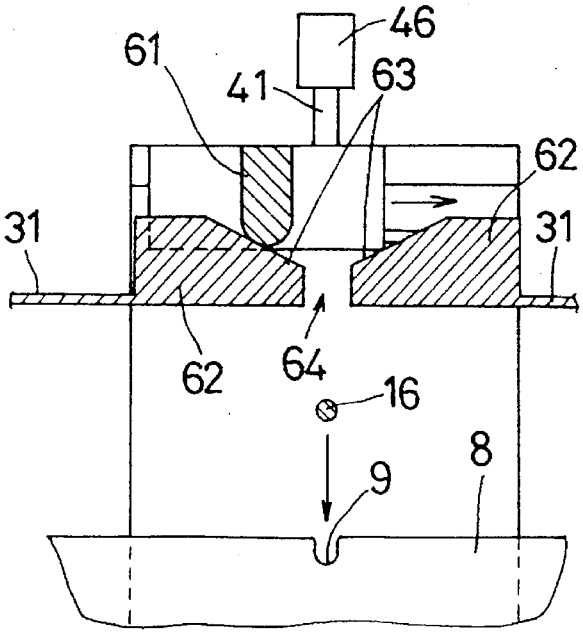
FIGS. 6A and 6B are fragmentary front views illustrating a sequence of installing a rack unit in a processing tank.

Thus, when each rack unit 10 is mounted in the processing tank 8 through the upper opening, the positioning projection 61, as shown in FIG. 6A contacts the ramp 63 of one of the guide plates 62. Then, the projection 61, under the weight of the rack unit 10, is guided in the direction indicated by an arrow in FIG. 6A, into engagement with the positioning recess 64 as shown in FIG. 6B.

The first drive line 30 will be described hereinafter with reference to FIGS. 2 and 3.

The first drive line 30 includes a friction unit 32 connected to an output shaft of a guide width varying motor M1 for protecting various components from damage due to an overload, a worm 33 rotatable coaxially with the friction unit 32, a worm wheel 34 meshing with the worm 33, a pinion gear 35 rotatable coaxially with the worm wheel 34, and a rack gear 36 meshing with the pinion gear 35.

Thus, with opposite rotations of the guide width varying motor M1, the drive plate 31 is reciprocable linearly in the direction of arrangement of the processing tanks 8. The linear reciprocation of drive plate 31 causes the connecting member 81 connected to the drive plate 31 to reciprocate linearly. This linear reciprocation causes the pair of guide members 11, through the guide width varying device 20, to move toward and away from each other, thereby to vary the distance between the guide members 11.

The transport mechanism 70 will be described next with reference to FIGS. 1, 2, 4 and 5.

As noted hereinbefore, part of the transport drive line for driving the transport rollers 71 is supported by the rack traits 10, and the rest of the transport drive line by the processing tanks 8.

Each rack unit 10 includes, arranged along a transport path of film 1, a pair of upper and lower transport rollers 71, and five press rollers 72 for pressing the upper transport roller 71 at opposite sides thereof and the lower transport roller 71 at opposite sides and a bottom thereof. Each transport roller 71 is fixed to a middle position of a roller shaft 73 having a roller driving gear 75 fixed to one end thereof. The roller shaft 73 slidably extends through bores formed in the pair of guide members 11, and is rotatably supported by the side walls 13 of the frame 12. Similarly, each press roller 72 is fixed to a middle position of a roller shaft 74. The roller shaft 74 slidably extends through bores formed in the pair of guide members 11, and is rotatably supported by the side walls 13 of the frame 12.

The part of the transport drive line supported by the processing tanks 8 includes a drive shaft 76 rotatably supported by the processing tanks 8 to extend in the direction of arrangement thereof and connected to a transport motor M2 through gearing, and worms 77*a* mounted on the drive shaft 76 and opposed to the respective processing tanks 8.

The part of the transport drive line supported by each rack unit 10 includes a worm wheel 77*b* meshing with one of the worms 77*a*, a first gear 78*a* rotatable coaxially with the worm wheel 77*b* and meshing with the roller driving gear 75 for driving the upper transport roller 71, and a second gear 78*b* and a third gear 78*c* meshing with each other for transmitting rotation of the upper roller driving gear 75 to the lower roller driving gear 75. A gear ratio is set to these gears to rotate the upper and lower transport rollers 71 at the same peripheral velocity.

The guide members 11 will be described next. As shown in FIG. 3, each guide member 11 includes an approximately U-shaped film guide groove 11*a* formed on an inward surface thereof for supporting and guiding the opposite side edges of film 1. The film guide groove 11*a* is designed such that a film inlet 11*b* and a film outlet 11*c* thereof are arranged very close to a film outlet 11*c* and a film inlet 11*b* of film guide grooves 11*a* in adjacent rack units 10. Consequently, the film 1 is smoothly transported under guiding action of the pair of guide members 11 in each rack unit 10.

That is, when the transport motor M2 is rotated forward, the rotation is transmitted to the part of the transport drive line supported by the processing tanks 8 and the part of the transport drive line supported by the rack units 10, to rotate the upper and lower transport rollers 71 forward. Then, the film 1 supported at the opposite side edges thereof in the film guide grooves 11*a*, and pressed on the upper and lower transport rollers 71 by the press rollers 72, is transported under the guiding action of the film guide grooves 11*a* successively through the processing tanks 8.

Sequences will be described hereinafter of mounting each rack unit 10 in the processing tank 8 and removing each rack unit 10 from the tank 8, for inspection, adjustment or the like of the rack unit 10, according to the photographic material developing apparatus having the above construction.

When removing each rack unit 10 from the processing tank 8, the operator lifts the rack unit 10 out of the tank 8 by gripping the upper wall 15 or the like of the frame 12 of the rack unit 10. At this time, the connecting member 81 of the rack unit 10 disengages from the connecting cutout 85*a* in the drive plate 31, whereby the connecting member 81 is disconnected from the drive plate 31. At the same time, the worm wheel 77*b* of the rack unit 10 disengages from the worm 77*a* on the drive shaft 75, thereby disconnecting the part of the transport drive line supported by the rack unit 10 from the part of the transport drive line supported by the processing tank 8.

After the rack unit 10 is taken out, the operator carries out an inspection, adjustment or the like of the second drive line 40 or guide width varying device 20 by turning the knob 46. It is therefore possible that the distance between the pair of guide members 11 is varied from what it was inside the processing tank 8.

For placing the rack unit 10 in the processing tank 8, the operator grips the upper wall 15 or the like of the frame 12 of the rack unit 10. Then, the operator inserts the rack unit 10 into the processing tank 8 through the upper opening thereof to an extent, for example, that the positioning projection 61 of the connecting member 81 lies adjacent the ramp 63 of one of the guide plates 62 of the drive plate 31.

Figure 6B:
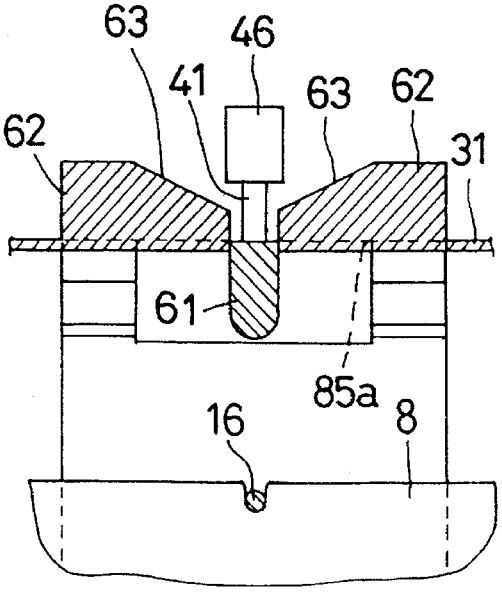

The rack unit 10 released by the operator falls by gravity, whereby the connecting member 81 moves toward the connecting cutout 85*a*, with the positioning projection 61 contacting and guided by the ramp 63 to engage the positioning recess 64, as shown in FIGS. 6A and 6B. The connecting member 81 then engages the connecting cutout 85*a* to be connected to the drive plate 31. The connecting member 81 now lies in the predetermined proper connecting position relative to the connecting cutout 85*a*. At the same time, the positioning pins 16 on the frame 12 engage the cutouts 9 formed in the upper edges of the processing tank 8. Thus, the rack unit 10 is fixed to a proper position relative to the processing tank 8. Further, the worm wheel 77*b* of the rack unit 10 meshes with the worm 77*a* on the drive shaft 76 to connect the part of the transport drive line supported by the rack unit 10 to the part of the transport drive line supported by the processing tank 8.

An outline of operation of the photographic material developing apparatus having the above construction will be described next.

First, the film holder 1*a* with a film leader drawn out is loaded into the film storage 2.

The control unit 4 operates the transport motor M2 to draw the film 1 from the film holder 1*a* by means of the feed rollers 7. The film width sensor 6 detects the width of film 1 and transmits detection information to the control unit 4. Based on the detection information received from the film width sensor 6, the control unit 4 operates the guide width varying motor M1 to adjust the passage width of film 1, i.e. the distance between each pair of guide members 11, to fit with the width of film 1 to be transported.

[Other Embodiments]

Other embodiments will be listed below.

Figure 7:
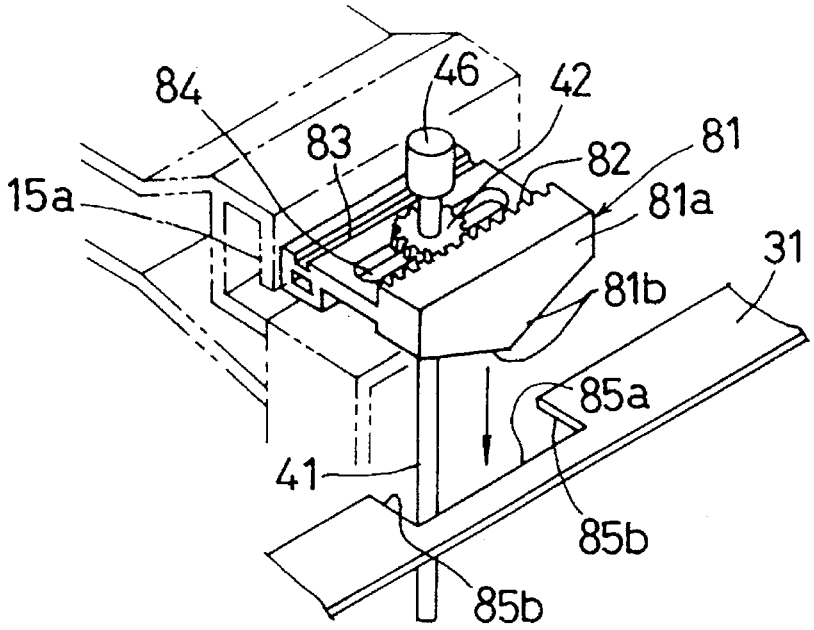
FIG. 7 is a perspective view of a guide mechanism in a different embodiment of the invention.
Figure 8A:
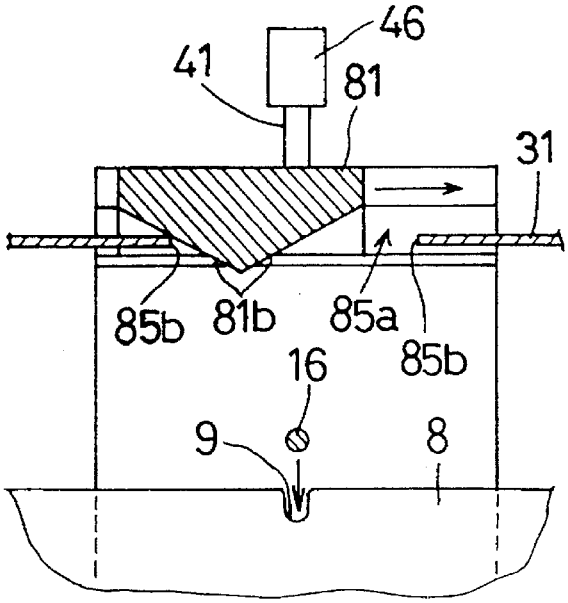
FIGS. 8A and 8B are fragmentary front views illustrating a sequence of installing a rack unit using the guide mechanism shown in FIG. 7.
Figure 8B:
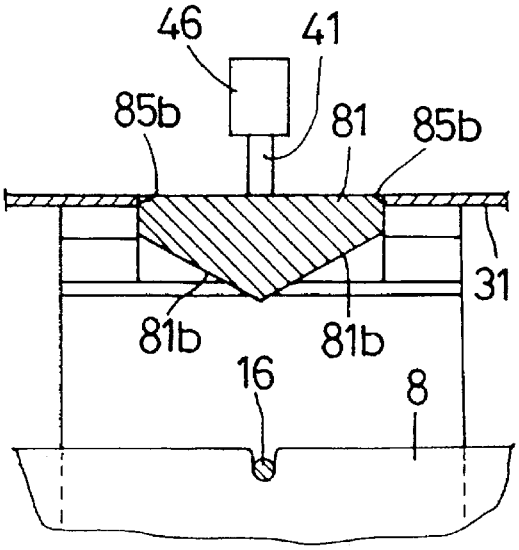

(1) As shown in FIGS. 7, 8A and 8*b*, the connecting member 81 may have a downwardly tapered shape with lower portions 81*a* of opposite side walls thereof, in the direction of arrangement of the processing tanks 8, inclined to converge downward. When each rack unit 10 is mounted in the processing tank 8, as shown in FIG. 8A, one of the inclined side walls 81*a* of the connecting member 81 contacts an edge 85*b*, in the direction of arrangement of the processing tanks 8, of the connecting cutout 85*a* in the drive plate 31. Then, the connecting member 81 is guided in the direction indicated by an arrow in FIG. 8A, into engagement with the connecting cutout 85*a* as shown in FIG. 8B. Thus, the edge 85*b* of the connecting cutout 85*a* acts as the guide mechanism 60. In this case, the construction is simplified since the guide plates 62 in the foregoing embodiment are not required.

(2) In the foregoing embodiment, the guide mechanism 60 is provided on the drive plate 31. Alternatively, the guide mechanism 60 may be provided on each processing tank 8.

Figure 9:
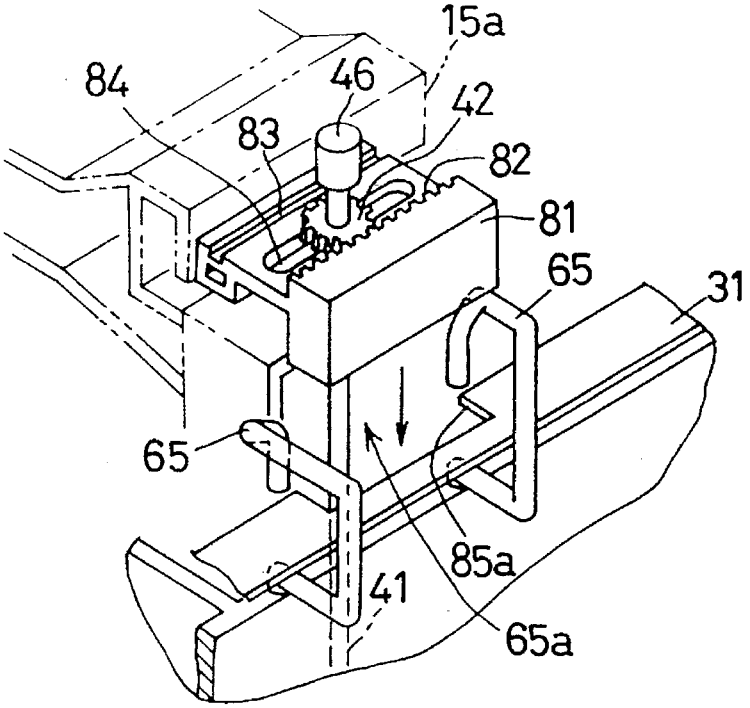
FIG. 9 is a perspective view of a guide mechanism in a further embodiment of the invention.
Figure 10A:
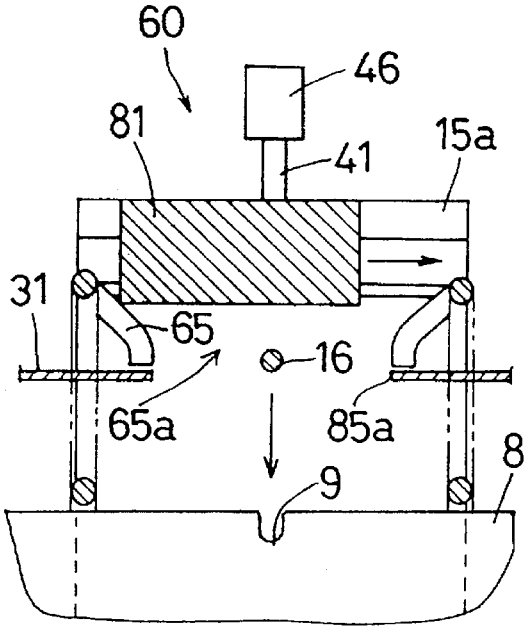
FIGS. 10A and 10B are fragmentary front views illustrating a sequence of installing a rack unit using the guide mechanism shown in FIG. 9.
Figure 10B:
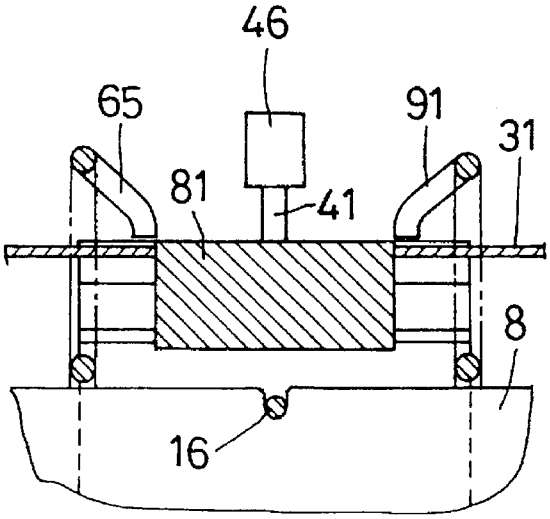

In this case, as shown in FIGS. 9 and 10, two curved rods 65 are fixed to a side wall of each processing tank 8. A guide space 65*a* is defined between the two rods 65 including portions converging downward in the direction of arrangement of the processing tanks 8 and portions extending downward therefrom and parallel to each other. When each rack unit 10 is mounted in the processing tank 8, the connecting member 81 passing through the guide space 65*a* is guided in the direction indicated by an arrow in FIG. 10A, to the proper connecting position. After passing through the guide space 65*a*, the connecting member 81 rests in engagement with the connecting cutout 85*a* in the drive plate 31 as shown in FIG. 10B. Thus, the guide space 65*a* defined by the two rods 65 acts as the guide mechanism 60.

(3) The automatic adjusting device 50 may be modified in various ways. For example, a device may be provided for directly moving the pair of guide members 11 to the proper position when each rack unit 10 is mounted in the processing tank 8. Such a device may include contact pieces formed on side walls of the processing tank 8 for contacting opposite side edges of the guide members 11 to move the guide members 11 to the proper position.

(4) Another modification of the automatic adjusting device 50 will be described hereunder.

Figure 11A:
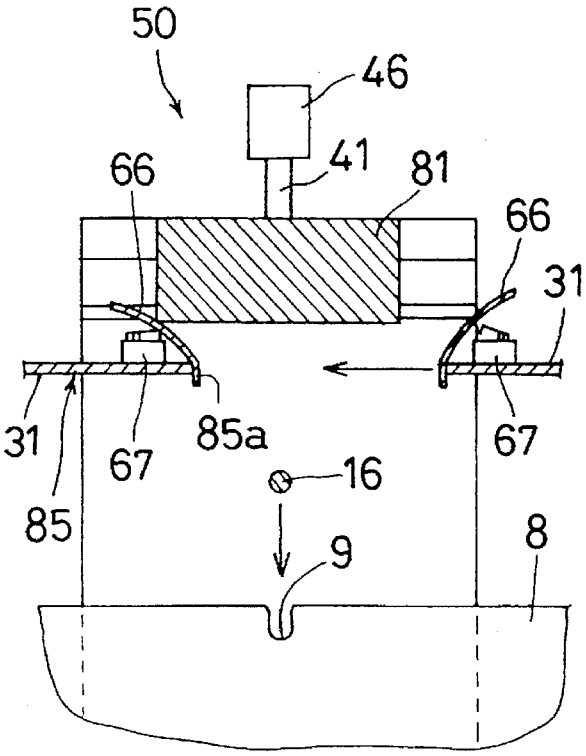
FIGS. 11A and 11B are fragmentary front views illustrating a sequence of installing a rack unit using an automatic adjusting device in a further embodiment.
Figure 11B:
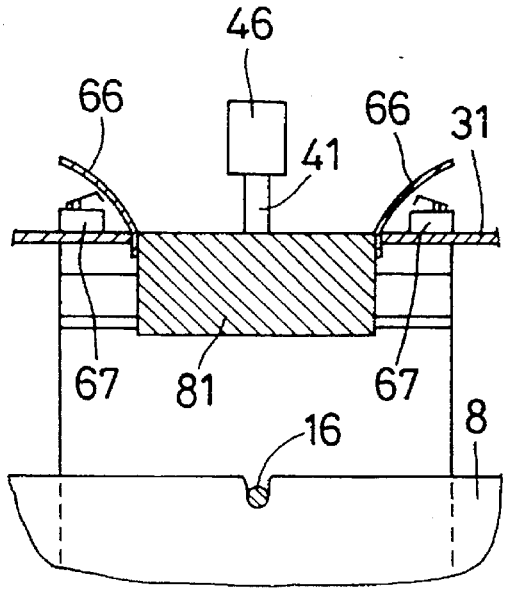

This automatic adjusting device 50 includes sensors for detecting a displacement of the connecting member 81 from the predetermined position relative to the connected member 85. Based on signals from the sensors, the first drive line 30 is operable to correct the position of the connected member 85. Specifically, as shown in FIGS. 11A and 11B, leaf springs 66 are attached to the opposite ends, in the direction of arrangement of the processing tanks 8, of the connecting cutout 85*a* in the drive plate 31. The leaf springs 66 are pressed by the connecting member 81 displaced from the proper connecting position when each rack unit 10 is mounted in the processing tank 8. Limit switches 67 are provided for transmitting signals when the leaf springs 66 are pressed. The limit switches 67 act as the sensors for detecting the displacement of the connecting member 81, and the guide width varying motor M1 acts as a drive source for correcting the displacement According to this construction, when each rack unit 10 is mounted in the processing tank 8, the connecting member 81 displaced from the proper connecting position presses the leaf springs 66, whereupon the limit switch 67 output signals. Based on these signals, the control unit 4 operates the guide width varying motor M1 to move the drive plate 31 to a position where neither of the limit switches 67 transmits a signal. With this control operation, the connecting member 81 engages the connecting cutout 85*a* in the drive plate 31.

(5) The connecting member 81 and drive plate 31 may be interconnected in any position without limiting to a particular position. For this purpose, the drive plate 31 may include, instead of the connecting cutout 85*a*, an engaging portion for engaging the connecting member 81 substantially in any selected position in the direction of arrangement of the processing tanks 8. The connecting member 81 may include, instead of the positioning projection 61, an engageable portion engageable with the engaging portion of the drive plate 31. When each rack unit 10 is mounted in the processing tank 8, the automatic adjusting device 50 guides the connecting member 81 to the proper connecting position to engage the engaging portion with the engageable portion. In this case, for example, the connecting member 81 and drive plate 31 in an engaged state must be movable together in any direction. This may be achieved by a plurality of meshing teeth arranged linearly to form the engaging portion and engageable portion. The automatic adjusting device 50 may comprise the guide space 65*a* provided on the processing tank 8 as shown in FIGS. 9 and 10.

(6) The foregoing embodiment has been described exemplifying a photographic material developing apparatus for developing film. Alternatively, the present invention may be applied to a photographic material developing apparatus for developing printing paper.

Such a photographic material developing apparatus for developing printing paper will be described hereinafter with reference to FIGS. 12 and 13.

Figure 12:
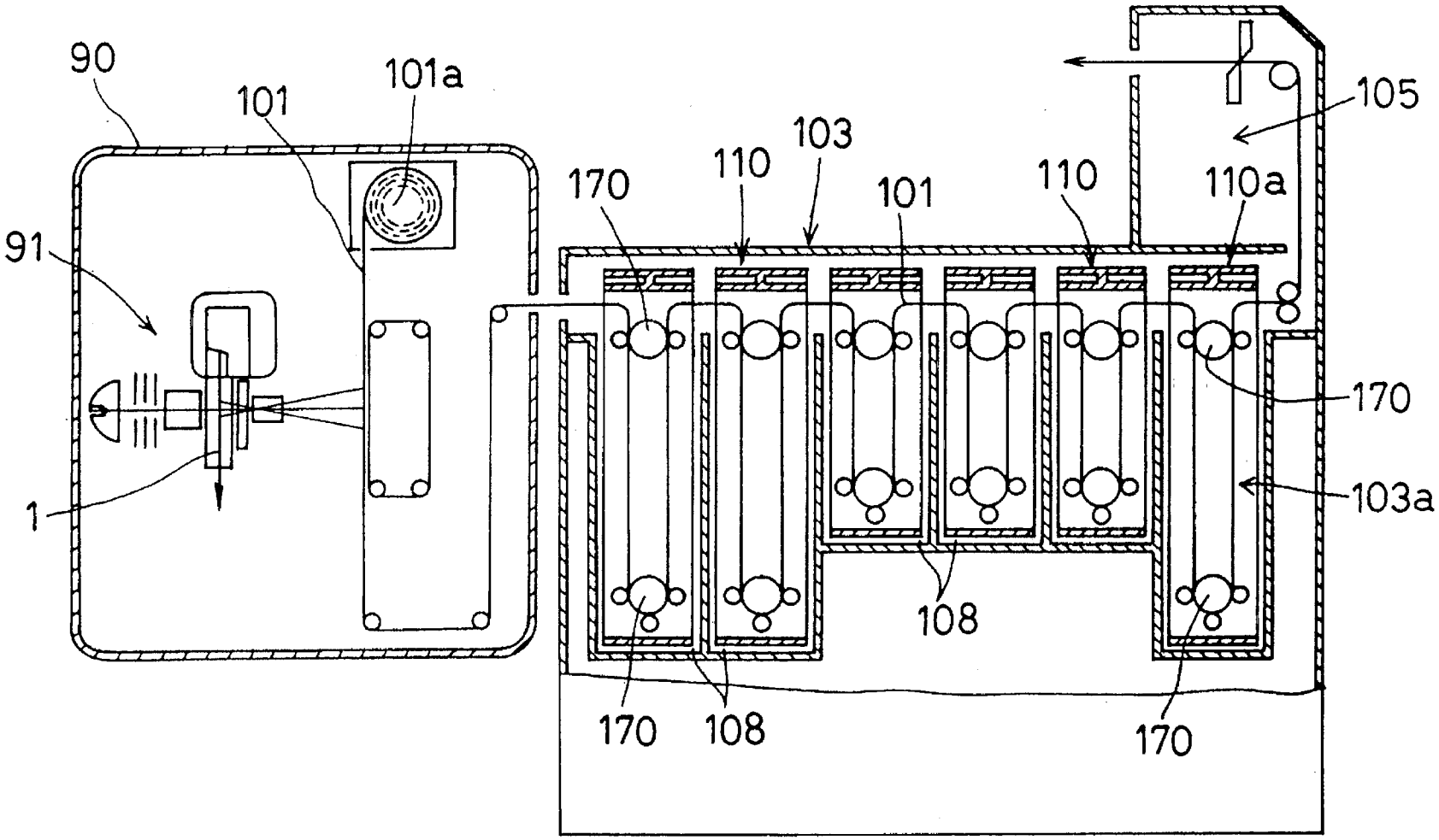
FIG. 12 is a schematic front view, in vertical section, of a photographic material developing apparatus in a further embodiment of the present invention.

As shown in FIG. 12, this developing apparatus includes an exposure station 90 having an exposing device 91 for exposing images of film 1 on printing paper 101 drawn from a magazine 101*a* into which the printing paper 101 has been loaded in roll form, a developing station 103 for developing the printing paper 101 exposed in the exposure station 90, a drying station 103*a* for drying the printing paper 101 developed in the developing station 103, and a cutter station 105 for cutting the printing paper 101 dried in the drying station 103*a* to a size including image information for each photograph and discharging the cut printing paper 101.

The developing station 103 includes a plurality of processing tanks 108 filled with various processing liquids for developing the printing paper 101, and a plurality of rack units 110 removably mounted in the processing tanks 108, respectively. The drying station 103*a* includes a rack unit 110*a* removably mounted in a casing thereof.

A transport mechanism 170 is provided for transporting the printing paper 101 successively through the rack units 110 in the developing station 103 and the rack unit 110*a* in the drying station 103*a*. The transport mechanism 170 has a similar construction to the transport mechanism 170 in the foregoing embodiment.

Figure 13:
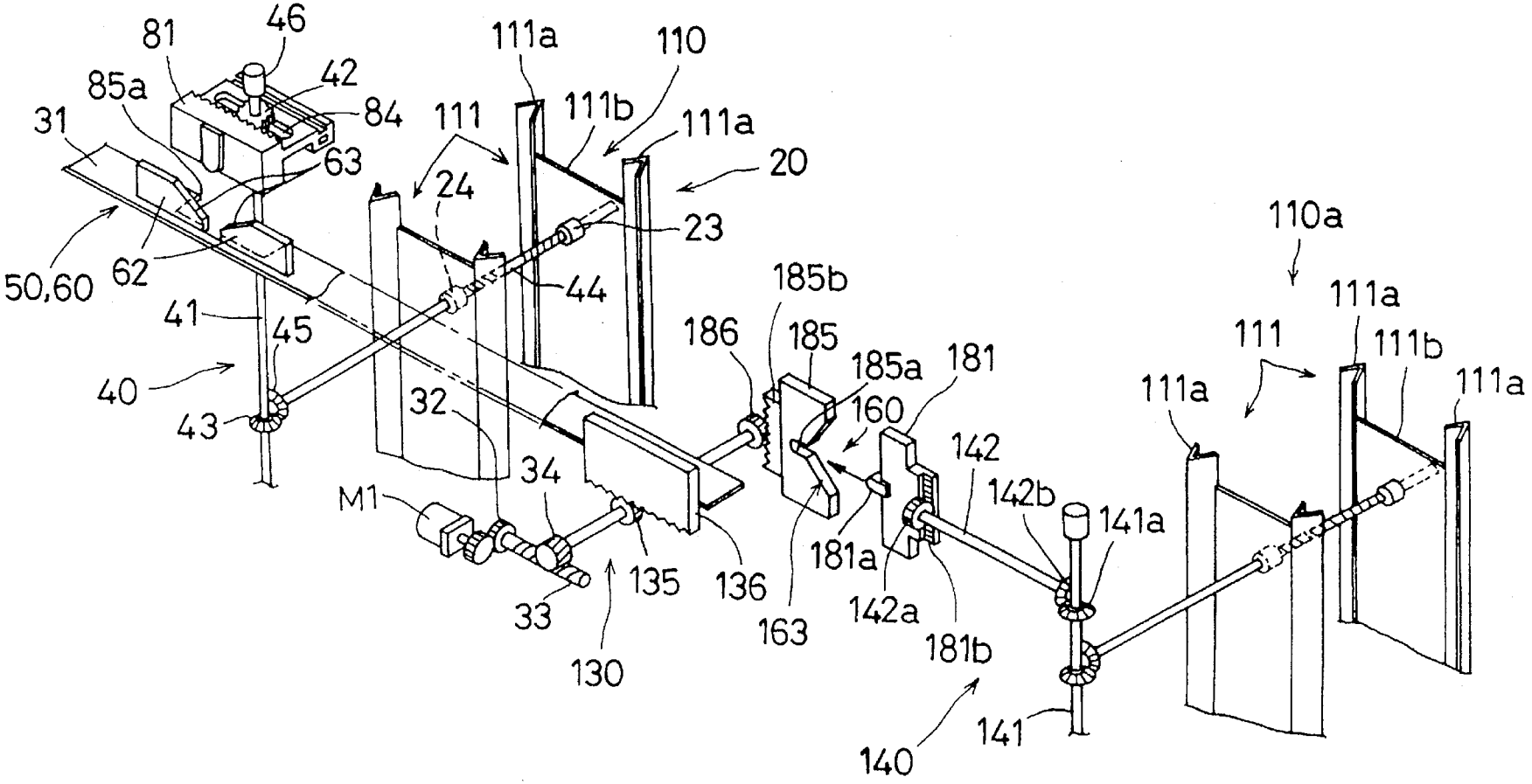
FIG. 13 is an exploded perspective view showing a drive line for a guide width varying device of the photographic material developing apparatus shown in FIG. 12.

As shown in FIG. 13, the rack units 110 in this embodiment are the same as the rack traits 10 in the foregoing embodiment, excepting that guide members herein are different from the guide members 11 in the foregoing embodiment.

As in the foregoing embodiment, a first drive line 130 includes a drive plate 31 acting as a central component thereof and extending along the processing tanks 108 for interlocking with and synchronously driving guide width varying devices 20. A connecting member 81 acts as an input of a second drive line 40 for transmitting power to the guide width varying device 20 of each rack unit 110. When each rack unit 110 is mounted in and removed from the processing tank 108, the connecting member 81 is movable into and out of engagement with a connecting cutout 85*a* in the drive plate 31 acting as an output of the first drive line 130.

As in the foregoing embodiment, an automatic adjusting device 50 is provided for automatically adjusting a relative position between the connecting member 81 and drive plate 31, so that the connecting member 81 is placed in a predetermined proper connecting position relative to the drive plate 31 when the rack unit 110 is mounted in the processing tank 8.

The automatic adjusting device 50 includes a guide mechanism 60 for guiding the connecting member 81 to the proper connecting position when the rack unit 110 is mounted in the processing tank 108. The guide mechanism 60 is formed on the drive plate 31.

Each rack unit 110 includes guide members 111 each having a pair of rails 111*a* for supporting and guiding side edges of printing paper 101, and a connecting plate 111*b* for interconnecting the rails 111*a*. The guide width varying device 20 includes nuts 23 and 24 fixed to the opposed connecting plates 111*b*.

The first drive line 130 for transmitting power from a guide width varying motor M1 is different from the first drive line 30 in the foregoing embodiment in that a rack gear 136 meshing with a pinion gear 135 is attached to the drive plate 31. The second drive line is the same as in the foregoing embodiment.

The rack unit 110*a* in the drying station 103*a* will now be described. The rack unit 110*a* has a first drive line 130 and a second drive line 140 different from the first drive line 130 and second drive line 140 of each rack unit 110, as described hereinafter.

The second drive line 140 of the rack unit 110*a* includes a connecting member 181 having a projecting piece 181*a* disposed at one end thereof and a rack gear 181*b* formed at the other end, and a connecting rod 142 having a pinion gear 142*a* formed at one end thereof and meshing with the rack gear 181*b*. The connecting rod 142 is interlocked to a rotary shaft 141 through bevel gears 142*b* and 141*a* mounted on the respective rod and shaft. Though not shown, the rack unit 110*a* is supported by a frame to be reciprocable linearly.

To connect the first drive line 130 disposed outside the rack unit 110*a* to the connecting member 181, the first drive line 130 includes a pinion gear 185 sharing the same axis with the pinion gear 135, a rack gear 185*b* meshing with the pinion gear 186, and a connected member 185 supporting the rack gear 185*b* and defining a recess 185*a* for receiving the projecting piece 181*a* of the connecting member 181. The connected member 185 also defines ramps 163 for reliably guiding the projecting piece 181*a* into the recess 185*a*. That is, the ramps 163 constitute a guide mechanism 160 for guiding the connecting member 181. Though not shown, the connected member 185 is supported by the casing of the drying station 103*a* to be reciprocable linearly. With opposite rotations of the guide width varying motor M1, the connected member 185 reciprocates linearly. The linear reciprocation of connected member 185 causes the connecting member 181 connected to the connected member 185 to reciprocate linearly. This linear reciprocation causes a pair of guide members 111, through a guide width varying device 20, to move toward and away from each other, thereby to vary the distance between the guide members 111, i.e. the passage width of the printing paper.

When the rack unit 110*a* is mounted in and removed from the drying station 103*a*, the connecting member 181 is movable into and out of engagement with the connected member 185, that is the second drive line 140 is connected to and disconnected from the first drive line 130. A the same time, the projecting piece 181*a* of the connecting member 181 is engageable with the recess 185*a* in the connected member 185, whereby the distance or passage width between the guide members 111 of the rack unit 110*a* equals the distance or passage width between the guide members 111 of the other rack units 110.

What is claimed is:

1. A photographic material developing apparatus having processing tanks, and rack units removably mounted in the processing tanks, respectively, said apparatus comprising:

a pair of guide members mounted in each of said rack units for guiding a photographic material passing through said processing tanks, said guide members being movable relative to each other to vary a distance therebetween defining a passage width of said photographic material;

guide width varying means for varying a relative position between said guide members to adjust said passage width;

a first drive line disposed outside each of said rack units;

a second drive line provided for each of said rack units and connected to said guide width varying means for driving said guide width varying means with power received from said first drive line; and coupling means disposed between said first drive line and said second drive line for enabling and disabling power transmission from said first drive line to said second drive line, said coupling means including:

a connected member disposed on said first drive line;

a connecting member disposed on said second drive line for connection to said connected member; and automatic adjusting means for automatically adjusting a relative position between said connecting member and said connected member, said automatic adjusting means comprising a guide mechanism for assisting said connecting member in displacement relative to said connected member to allow said connecting member and said connected member to be connected to each other in a predetermined relative position;

said connecting member being displaceable with said connected member, while connected in said predetermined relative position, to cause said guide width varying means to vary said distance between said guide members.

2. A photographic material developing apparatus as defined in claim 2, wherein said guide mechanism includes ramps formed on said connected member.

3. A photographic material developing apparatus as defined in claim 1, wherein said connecting member is displaceable relative to said connected member, prior to connection therebetween, to cause said guide width varying means to vary said distance between said guide members, whereby said guide members define a passage width as a predetermined reference width.

4. A photographic material developing apparatus as defined in claim 1, wherein said connecting member includes a rack gear, and said second drive line includes a pinion gear meshing with said rack gear, a linear displacement of said connecting member and said connected member, while connected, is transmitted to said second drive line as a rotational displacement through said rack gear and said pinion gear.

5. A photographic material developing apparatus as defined in claim 1, wherein said automatic adjusting means includes sensors for detecting a displacement of said connecting member from said predetermined relative position, and a motor operable in response to signals from said sensors to correct a position of said connected member through said first drive line.

6. A photographic material developing apparatus as defined in claim 1, wherein said connected member and said connecting member have mutually fitting geometric configurations, respectively.

7. A photographic material developing apparatus having processing tanks, and rack units removably mounted in the processing tanks, respectively, said apparatus comprising:

a pair of guide members mounted in each of said rack units for guiding a photographic material passing through said processing tanks, said guide members being movable relative to each other to vary a distance therebetween defining a passage width of said photographic material;

guide width varying means for varying a relative position between said guide members to adjust said passage width;

a first drive line disposed outside each of said rack units;

a second drive line provided for each of said rack units and connected to said guide width varying means for driving said guide width varying means with power received from said first drive line; and coupling means disposed between said first drive line and said second drive line for enabling and disabling power transmission from said first drive line to said second drive line, said coupling means including:

a connected member disposed on said first drive line;

a connecting member disposed on said second drive line for connection to said connected member; and automatic adjusting means for automatically adjusting a relative position between said connecting member and said connected member, said automatic adjusting means comprising ramps which guide said connecting member during displacement relative to said connected member to allow said connecting member and said connected member to be connected to each other in a predetermined relative position.

8. A photographic material developing apparatus as defined in claim 7, wherein said ramps are found on said connected member.

9. A photographic material developing apparatus having processing tanks, and rack units removably mounted in the processing tanks, respectively, said apparatus comprising:

a pair of guide members mounted in each of said rack units for guiding a photographic material passing through said processing tanks, said guide members being movable relative to each other to vary a distance therebetween defining a passage width of said photographic material;

guide width varying means for varying a relative position between said guide members to adjust said passage width;

a first drive line disposed outside each of said rack units;

a second drive line provided for each of said rack units and connected to said guide width varying means for driving said guide width varying means with power received from said first drive line; and coupling means disposed between said first drive line and said second drive line for enabling and disabling power transmission from said first drive line to said second drive line, said coupling means including:

a connected member disposed on said first drive line;

a connecting member disposed on said second drive line for connection to said connected member; and automatic adjusting means for automatically adjusting a relative position between said connecting member and said connected member to allow said connecting member and said connected member to be connected to each other in a predetermined relative position, said automatic adjusting means comprising sensor means for detecting a displacement of said connecting member from said predetermined relative position, and a motor operable in response to signals from said sensor means to connect a position of said connected member through said first drive line.

* * * * *

UNITED STATES PATENT AND TRADEMARK OFFICE

CERTIFICATE OF CORRECTION

PATENT NO. : 5,669,034
DATED : September 16, 1997
INVENTOR(S) : Yamada

It is certified that error appears in the above-identified patent and that said Letters Patent is hereby corrected as shown below:

In Claim 2, column 12, line 13 of the Patent, following the word "claim", change "2" to --1--

Signed and Sealed this

Twenty-fifth Day of May, 1999

*Attest:*

Q. TODD DICKINSON

*Attesting Officer*

*Acting Commissioner of Patents and Trademarks*